US008152258B2

(12) United States Patent
Kang et al.

(10) Patent No.: US 8,152,258 B2
(45) Date of Patent: Apr. 10, 2012

(54) ELEVATION ADJUSTMENT APPARATUS FOR SHELF IN REFRIGERATOR

(75) Inventors: Byeong-Gyu Kang, Changwon (KR); Jae-Youl Lee, Changwon (KR); Jeong-Ho Shin, Changwon (KR); Ki-Hoon Song, Changwon (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 12/513,601

(22) PCT Filed: Nov. 14, 2007

(86) PCT No.: PCT/KR2007/005715

§ 371 (c)(1), (2), (4) Date: May 5, 2009

(87) PCT Pub. No.: WO2008/062965

PCT Pub. Date: May 29, 2008

(65) Prior Publication Data

US 2010/0060124 A1 Mar. 11, 2010

(30) Foreign Application Priority Data

Nov. 20, 2006 (KR) ..... 10-2006-0114406

(51) Int. Cl.
*A47B 96/04* (2006.01)

(52) U.S. Cl. ..... 312/408; 108/108; 211/187

(58) Field of Classification Search ..... 312/408; 108/108; 211/187

See application file for complete search history.

(56) References Cited

U.S. PATENT DOCUMENTS

| | | | | |
|---|---|---|---|---|
| 464,918 | A | 12/1891 | Bacon | |
| 766,605 | A | 8/1904 | Dilg | |
| 2,002,339 | A | 5/1935 | Copeman | |
| 2,784,603 | A | 3/1957 | Collins | |
| 3,054,511 | A | 9/1962 | Erismann | |
| 3,128,074 | A | 4/1964 | Schwarz | |
| 3,316,044 | A | 4/1967 | Carbary | |
| 3,337,283 | A | 8/1967 | Schlenkert | |
| 3,356,328 | A | 12/1967 | Sachau | |
| 3,437,060 | A | 4/1969 | Giambalvo | |
| 3,601,432 | A * | 8/1971 | Fenwick et al. | 403/230 |
| 3,726,581 | A | 4/1973 | Doepke | |
| 3,730,108 | A * | 5/1973 | Stroh | 108/108 |
| 3,848,844 | A | 11/1974 | Barrett | |

(Continued)

FOREIGN PATENT DOCUMENTS

CN 2248266 Y 2/1997

(Continued)

*Primary Examiner* — Korie Chan

(74) *Attorney, Agent, or Firm* — Birch, Stewart, Kolasch & Birch, LLP

(57) ABSTRACT

In order to can conveniently operate the elevation of the shelf, move the shelf only by the movement of the shelf without performing the separate work in order to allow the user to move the shelf, and automatically fix the position of the shelf by means of the restoring force of the elastic member after the movement of the shelf is completed, the present invention discloses an elevation adjustment apparatus for a shelf in a refrigerator comprising an engaging guide lengthily formed up and down in the inside of the refrigerator; a shelf movably mounted up and down along the engaging guide; an engaging apparatus rotatably supported on the shelf and re-stricting the downward movement of the shelf by selectively hooking it on any position of the engaging guide by a rotation operation; and a load supporting apparatus supporting the load of the shelf at the position fixing the shelf by the engaging apparatus.

10 Claims, 6 Drawing Sheets

U.S. PATENT DOCUMENTS

| | | | | | |
|---|---|---|---|---|---|
| 3,885,846 | A | * | 5/1975 | Chuang et al. | 312/306 |
| 4,056,196 | A | | 11/1977 | Brauning | |
| 4,156,515 | A | | 5/1979 | Mochly | |
| 4,299,368 | A | | 11/1981 | Winkler | |
| 4,901,965 | A | | 2/1990 | Bowman | |
| 5,199,778 | A | | 4/1993 | Aoki et al. | |
| 5,338,137 | A | * | 8/1994 | Jensen | 410/146 |
| 5,381,738 | A | | 1/1995 | Meyer | |
| 5,415,302 | A | | 5/1995 | Carlson et al. | |
| 5,483,902 | A | | 1/1996 | Grosch | |
| 5,531,167 | A | | 7/1996 | Stevens et al. | |
| 5,644,993 | A | | 7/1997 | Dohnalik | |
| 5,687,655 | A | * | 11/1997 | Weinschenk et al. | 108/147 |
| 5,913,584 | A | | 6/1999 | Swindell et al. | |
| 6,017,009 | A | | 1/2000 | Swartz et al. | |
| 6,065,821 | A | * | 5/2000 | Anderson et al. | 312/408 |
| 6,105,794 | A | | 8/2000 | Bauer | |
| 6,113,042 | A | | 9/2000 | Welsch et al. | |
| 6,811,045 | B1 | | 11/2004 | Masker et al. | |
| 7,455,629 | B2 | | 11/2008 | Abelbeck | |
| 2006/0013676 | A1 | | 1/2006 | Oh et al. | |

FOREIGN PATENT DOCUMENTS

| | | | |
|---|---|---|---|
| FR | 2850002 | A1 | 7/2004 |
| KR | 10-1997-0011759 | A | 3/1997 |
| KR | 20-1997-0014663 | U | 4/1997 |
| KR | 20-1999-0009504 | U | 3/1999 |
| WO | WO 91/13314 | A1 | 9/1991 |

* cited by examiner

[Fig. 1]
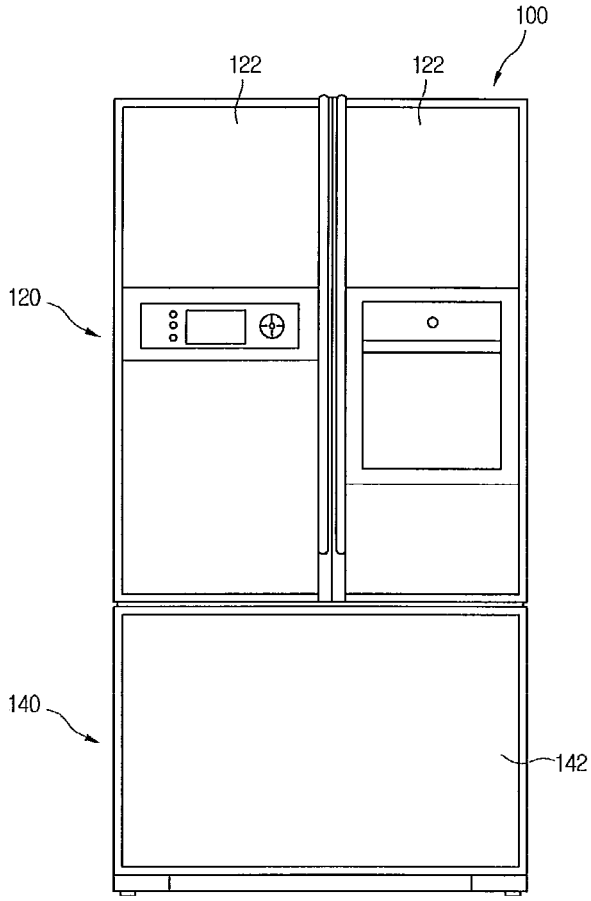
[Fig. 2]
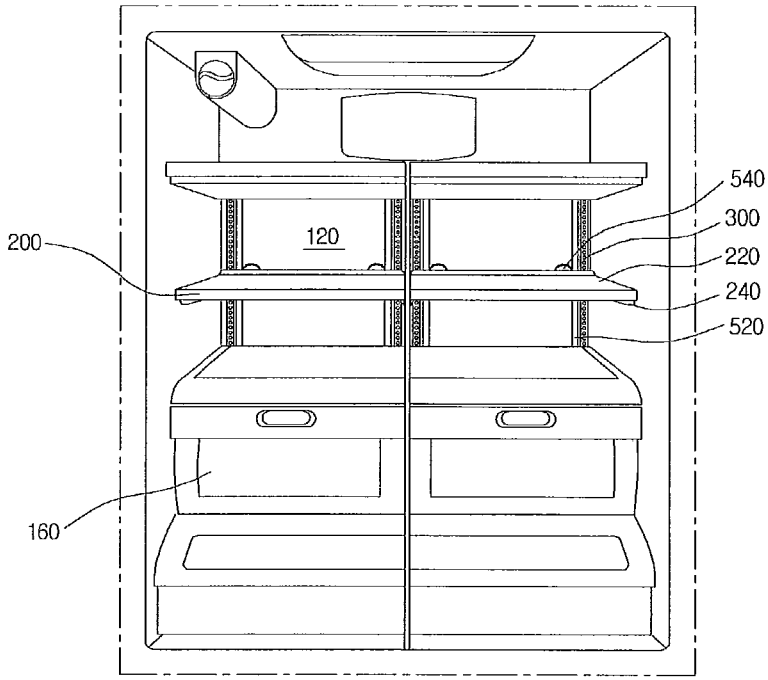

[Fig. 3]
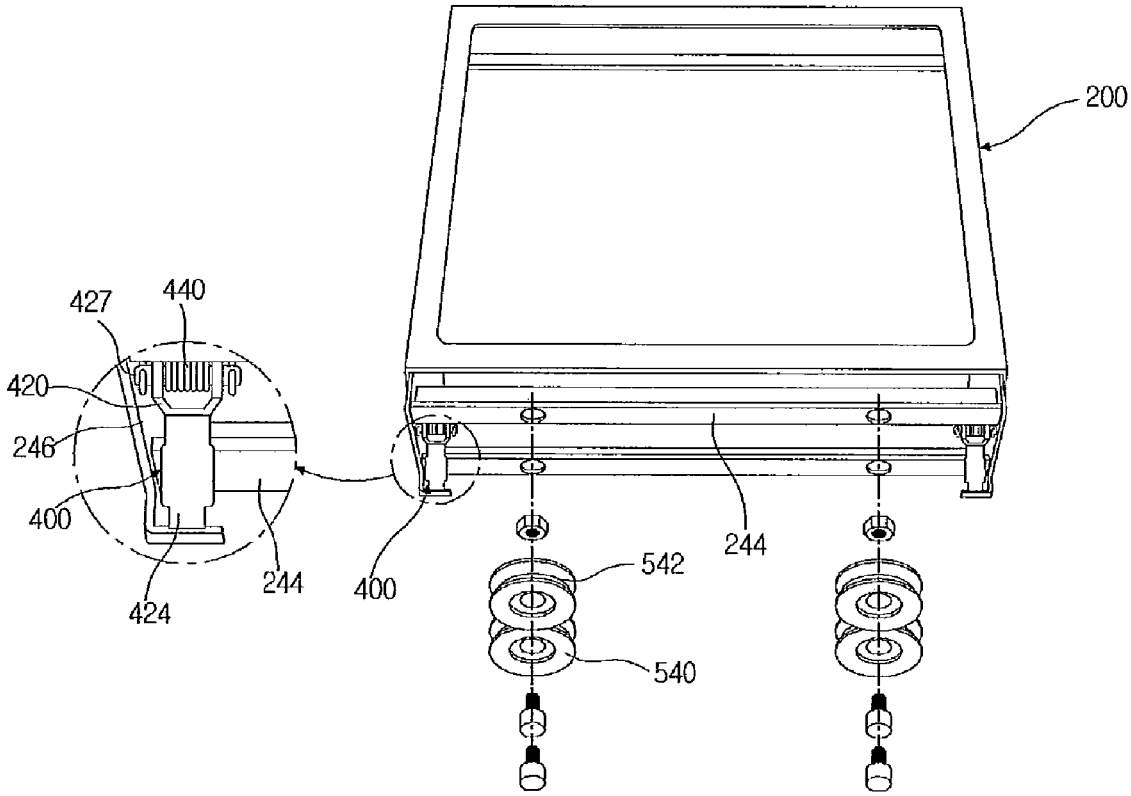
[Fig. 4]
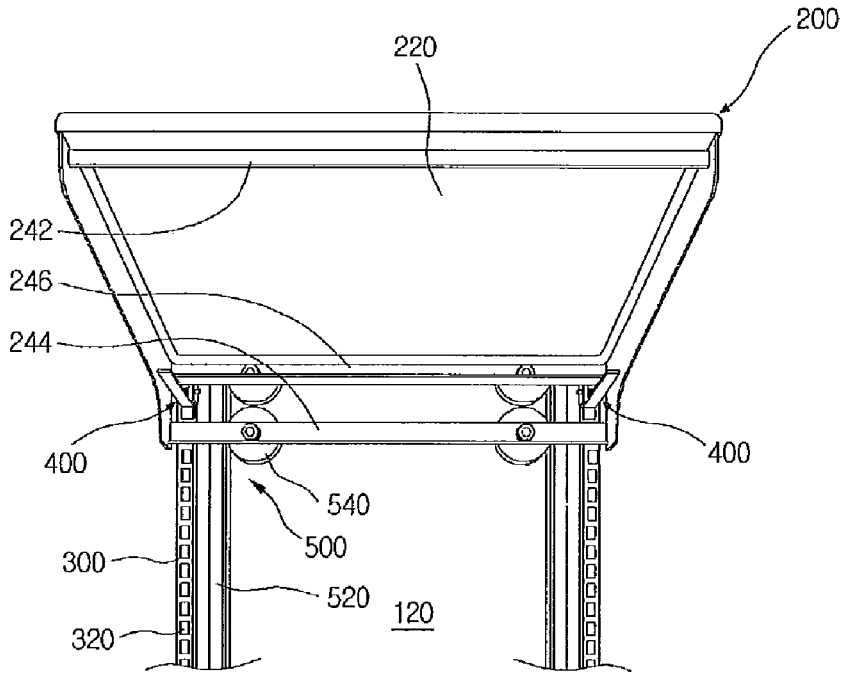

[Fig. 5]
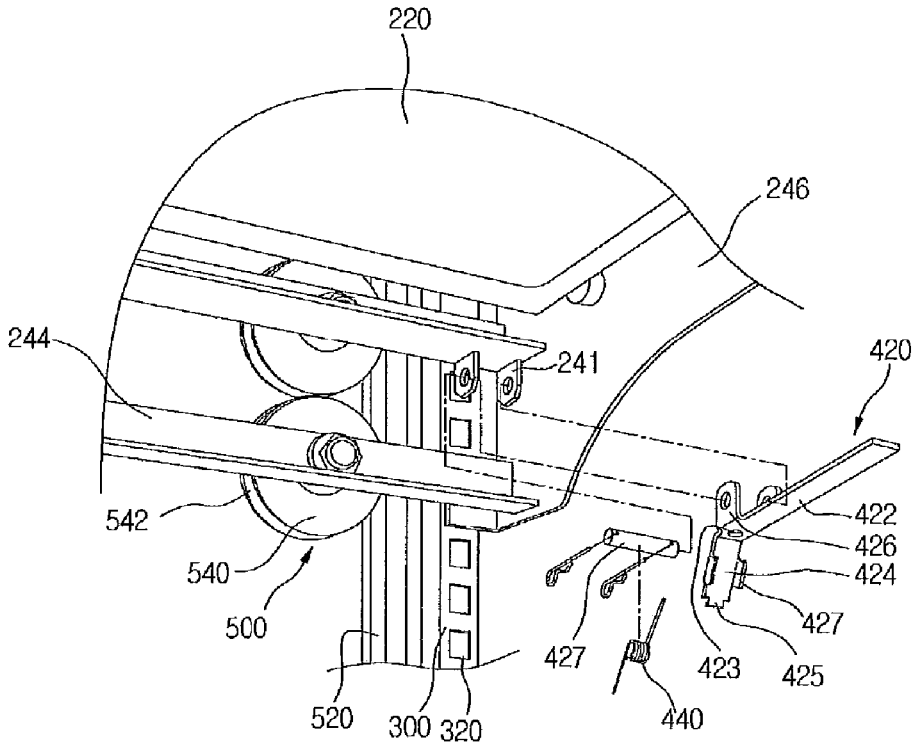
[Fig. 6]
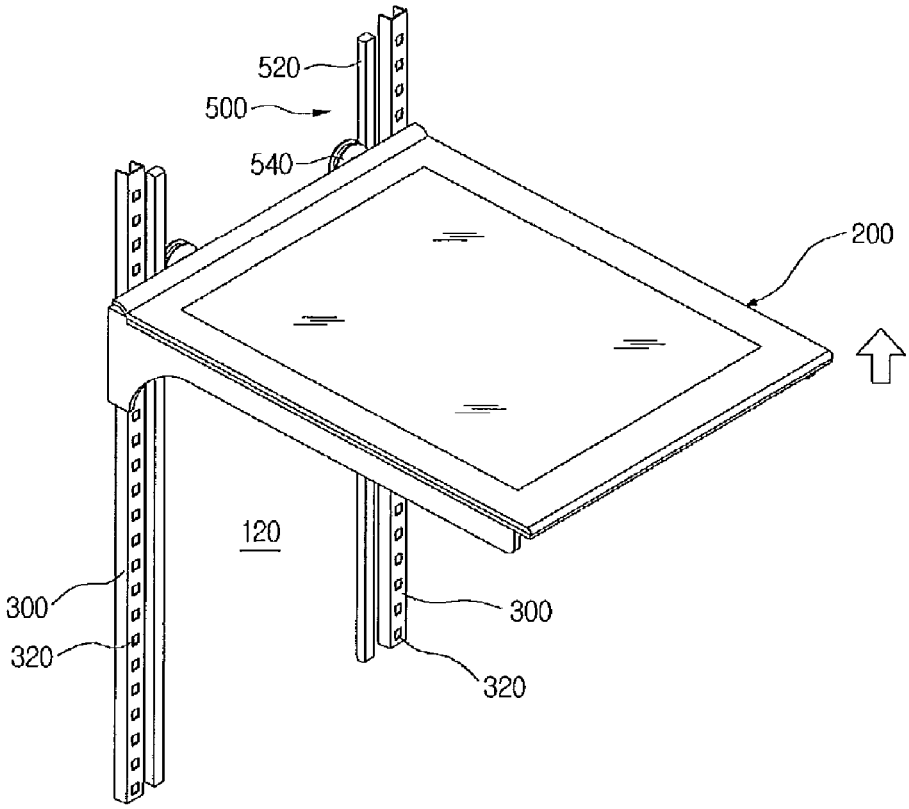

[Fig. 7]
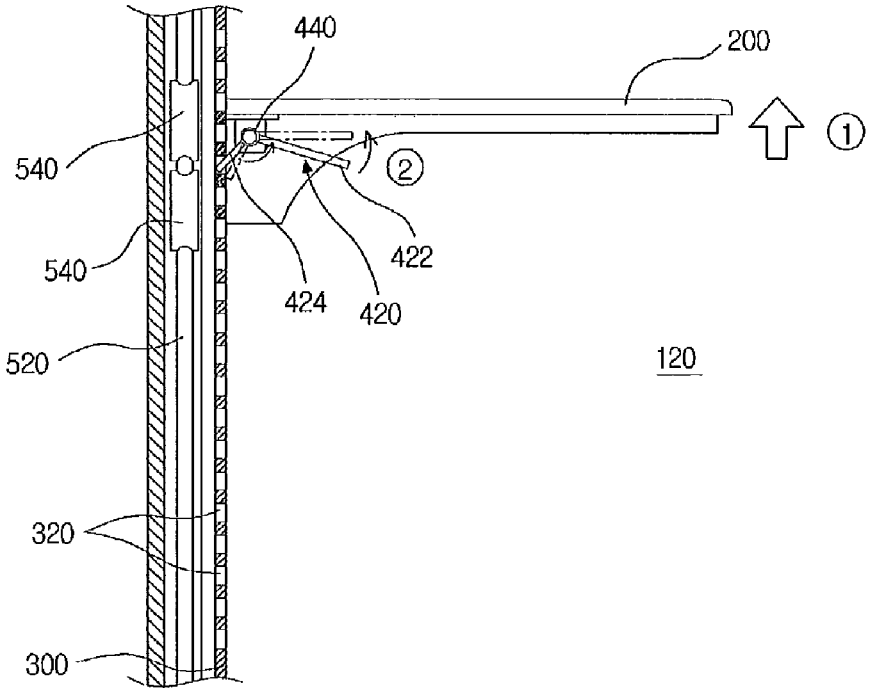
[Fig. 8]
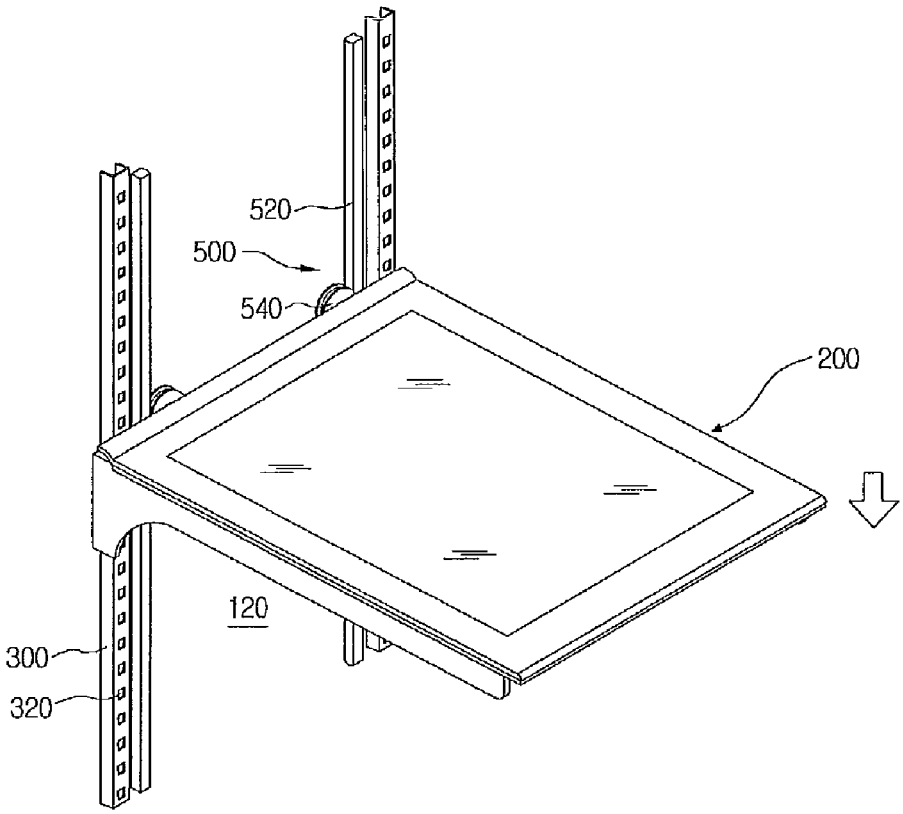

[Fig. 9]
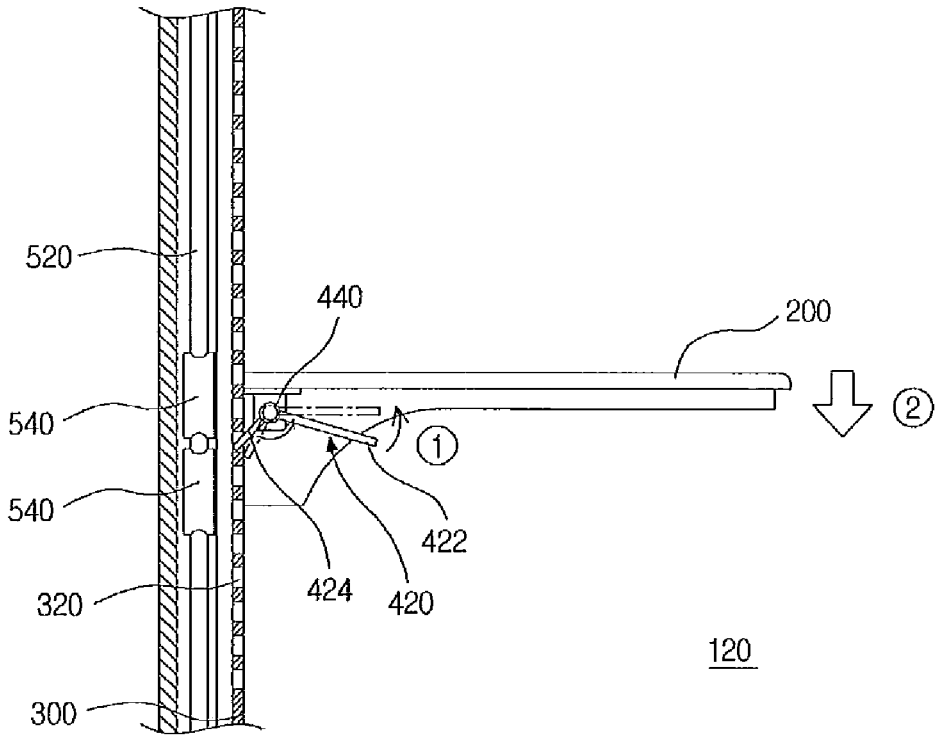
[Fig. 10]
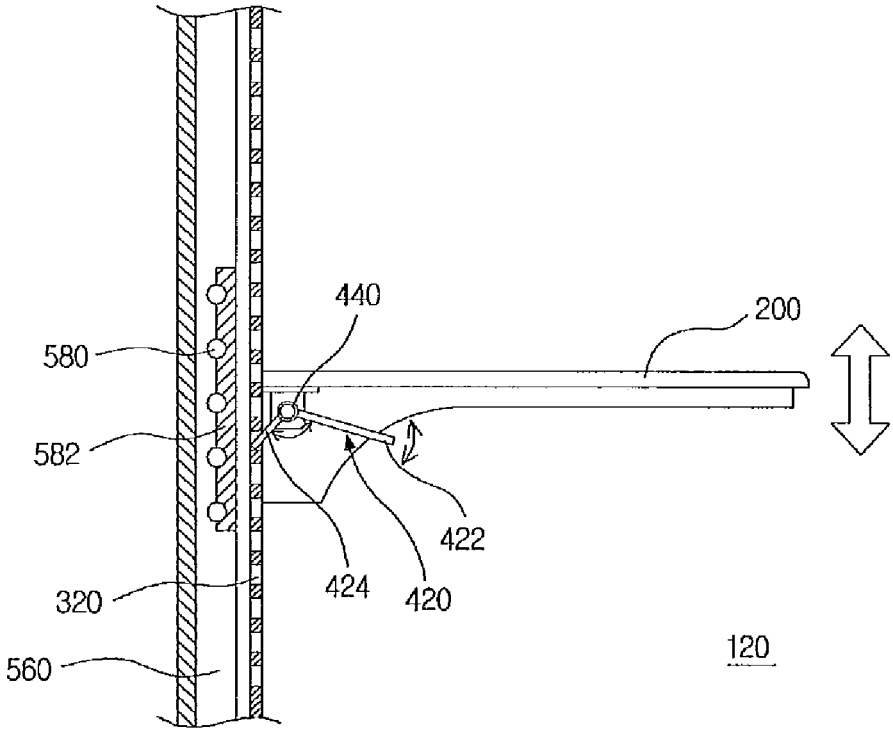

[Fig. 11]
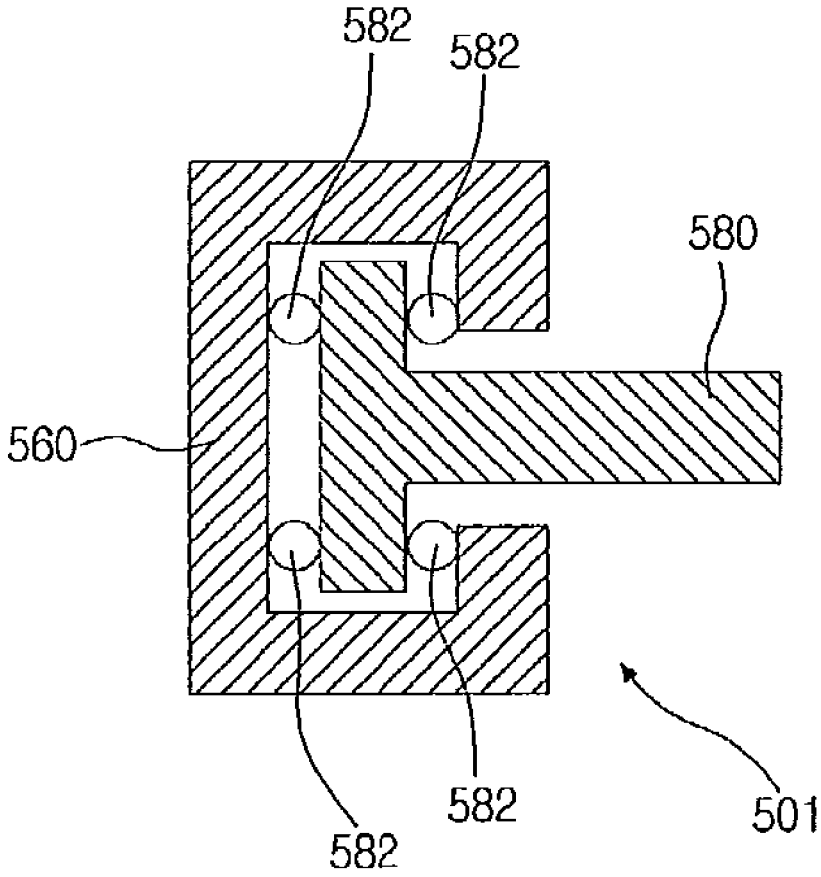

ELEVATION ADJUSTMENT APPARATUS FOR SHELF IN REFRIGERATOR

TECHNICAL FIELD

This document relates to a refrigerator, and more specifically to an elevation adjustment apparatus for a shelf in a refrigerator to move a shelf in the inside of the refrigerator up and down and stably maintain an elevation selected after the shelf is moved.

BACKGROUND ART

A regfrigerator is an apparatus for storing foods at a low temperature and is for the frozen storage and refrigeration storage of foods according to the state of foods to be stored.

Cold air supplied to the inside of the refrigerator is generated by means of a heat exchanging action of refrigerant and is continuously supplied to the refrigerator by repeatedly performing a compression-condensation-expansion-evaporation cycle. The supplied refrigerant is uniformly transferred to the inside of the refrigerator by means of convection so that foods can be stored in the refrigerator at a desired temperature. Such a refrigerator shows a tendency to be bigger and multi-functional and takes various forms according to a form of a storage space.

Various foods to be stored in the refrigerating or freezing state are properly stored in a shelf, a drawer, a basket, or the like provided in the inside of the refrigerator. The drawer, shelf, basket, or the like partitions the inside of the refrigerator so that they can store foods with various sizes and storage conditions.

Meanwhile, the mount position of the shelf partitioning the inside of the refrigerator is changed so that the space form of the inside of the refrigerator can be changed. As a result, a user can form a proper space by adjusting the mount position of the shelf so as to receive foods with various sizes or a food container. The representative mount structure of such a shelf is a structure that forms molded ends on left and right wall surfaces of the inside of the refrigerator and places the shelf thereon. However, in such a structure, since the shelf can be mounted only on the position where the molded end is formed, there is any limitation in mounting the shelf as well as manufacturing cost is increased and the aesthetic sense of a design is degraded, due to the formation of many molded ends.

Meanwhile, as another mount structure of the shelf, there is a structure that mounts the shelf in a form such as a cantilever by mounting guide with a plurality of holes on a rear wall surface of the inside of the refrigerator and coupling the shelf with a coupling part in a ring shape with the holes of the guide.

However, even in such a structure, the shelf should be completely separated and then assemblied again in order to change the mount position of the shelf. To this end, the user puts down all foods on the shelf and the assembles the shelf at a new position. Thereafter, the user puts all foods on the shelf again. Also, each time that the user mounts the shelf, he/she should properly balance its horizon, etc. Therefore, considerable inconvenience is caused in mounting the shelf.

In order to solve the problems, U.S. Pat. No. 6,065,821 discloses the shelf structure capable of adjusting the up and down elevations of the shelfs engaged by means of a gear coupling by turning a handle or a lever mounted to the shelf.

However, in such a conventional technology, since the handle should be continuously turned in order to adjust the elevation of the shelf, when the movement distance of the shelf is distant, the handle should be turned for a long time, causing the inconvenience of use. Further, when foods put on the shelf, the problems such as consuming more time and energy, etc., in operating the handle in order to move the shelf up due to their weight are caused. Also, since the components in a gear shape or a sprocket shape perform a relative movement, considerable noise is caused and when foods put on the shelf, the loud noise is caused so that sensibility dissatisfaction of a user is caused. Also, since its structure is complicated, it is difficult to separate and mount the shelf.

DISCLOSURE OF INVENTION

Technical Problem

It is an object of the present invention to provide an elevation adjustment apparatus for a shelf in a refrigerator that is convenient for a user operation by permitting a user to conveniently move a shelf to a considerable distance at a time, simplifying its operation, simplifying its separation and mount, and simplifying its constitution.

Technical Solution

An elevation adjustment apparatus of a shelf in a refrigerator according to the present invention comprises: an engaging guide lengthily formed up and down in the inside of the refrigerator; a shelf movably mounted up and down along the engaging guide; an engaging apparatus rotatably supported on the shelf and restricting the downward movement of the shelf by selectively hooking it on any position of the engaging guide by a rotation operation; and a load supporting apparatus supporting the load of the shelf at the position fixing the shelf by the engaging apparatus.

An elevation adjustment apparatus of a shelf in a refrigerator according to the present invention comprises: an engaging guide lengthily formed up and down in the inside of the refrigerator; a plurality of engaging members provided in the engaging guide at a constant interval; a position fixed shelf by hooking on the engaging guide; and an operating lever rotatably supported on the shelf and fixing the position of the shelf by hooking its one side on the engaging member.

An elevation adjustment apparatus of a shelf in a refrigerator according to the present invention comprises: an engaging guide lengthily formed in the inside of the refrigerator; a plurality of engaging members provided in the engaging guide; a shelf movably mounted up and down along the engaging guide; an engaging apparatus rotatably supported in a state supported on the shelf and restricting the downward movement of the shelf by selectively hooking it on any engaging members by a rotation operation; a roller guide lengthily formed up and down in the inside of the refrigerator; and a roller rotatably mounted to the shelf and guided and rotated to the roller guide.

An elevation adjustment apparatus of a shelf in a refrigerator according to the present invention comprises: an engaging guide lengthily formed in the inside of the refrigerator; a shelf movably mounted up and down along the engaging guide; an engaging apparatus rotatably supported on the shelf by means of a pin coupling and restricting the downward movement of the shelf by selectively hooking it on any position of the engaging guide by a rotation operation; a protruding part protruded to the rear of the shelf a receiving guide lengthily formed up and down in the inside of the refrigerator and supporting the protruding part; and a rolling member interposed between the receiving guide and the contacting part of the protruding part and performing a rolling movement.

An elevation adjustment apparatus of a shelf in a refrigerator according to the present invention comprises: a plurality of engaging members spaced from each other and provided to the engaging guide; a shelf movably mounted up and down along the engaging guide; an operating lever rotatably supported on the shelf and restricting the downward movement of the shelf by applying the elastic force in a direction hooking on the engaging member; and a load supporting apparatus supporting the load of the shelf at the position fixing the shelf by the operating lever.

Advantageous Effects

With the present invention, the shelf can be moved only by the movement of the shelf without performing a separate work for the movement of the shelf and after the movement of the shelf is completed, the position of the shelf is automatically fixed by means of the restoring force of the elastic member. As a result, the user convenience is improved. Also, the shelf can be moved to a desired position at a time irrespective of the movement distance of the shelf so that the elevation of the shelf can be rapidly adjusted without exerting a great force.

Also, when adjusting the elevation of the shelf, the shelf does not need to be separated from the refrigerator so that the convenience of use is maximized.

Also, in order to separate the shelf, if the user lifts up the shelf to the ends of the engaging guide and the roller guide, the shelf is completely separated from the engaging guide and the roller guide and in order to mount the shelf again, the shelf inserted in the upper ends of the engaging guide and the roller guide moves downward in the state of rotating the operating lever by pressing a holding part.

As such, it can be expected that workability can be improved by easily mounting the shelf and the space form of the refrigeration chamber can be variously formed by easily detaching the shelf.

BRIEF DESCRIPTION OF THE DRAWINGS

FIG. 1 is a front view showing an external form of a refrigerator;

FIG. 2 is a partial front view showing a shape that a door for a refrigerator adopting an elevation adjustment apparatus for a shelf in a refrigerator according to the present embodiment is opened;

FIG. 3 is a rear perspective view of the shelf according to the present embodiment viewed from the rear;

FIG. 4 is a bottom perspective view showing a shape that a drawer according to the present embodiment is mounted, viewed from the bottom;

FIG. 5 is an exploded perspective view showing a constitution of an engaging apparatus in an elevation adjustment apparatus for a shelf in a refrigerator according to the present embodiment;

FIG. 6 is a perspective view showing a shape that the shelf in the elevation adjustment apparatus for the shelf in the refrigerator according to the present embodiment is moved upward;

FIG. 7 is a schematic side view showing the operation of the engaging apparatus in the state where the shelf in the elevation adjustment apparatus for the shelf in the refrigerator according to the present embodiment is moved upward;

FIG. 8 is a perspective view showing a shape that the shelf in the elevation adjustment apparatus for the shelf in the refrigerator according to the present embodiment is moved downward;

FIG. 9 is a schematic side view showing the operation of the engaging apparatus in the state where the shelf in the elevation adjustment apparatus for the shelf in the refrigerator according to the present embodiment is moved downward;

FIG. 10 is a schematic side view showing a constitution of another embodiment of an elevation adjustment apparatus for a shelf in a refrigerator according to the present invention; and FIG. 11 is a schematic view showing a cross section of line I-I' of FIG. 10.

BEST MODE FOR CARRYING OUT THE INVENTION

Hereinafter, the preferred embodiments of an elevation adjustment apparatus for a shelf in a refrigerator will be described in detail with reference to the accompanying drawings.

The embodiment of the present invention describes, by way of example, a bottom freeze type refrigerator where a freezing chamber is positioned at a lower portion of a refrigeration chamber for convenience of explanation. However, the present invention is not limited to the types of the refrigerator, but can be applied to both of the refrigeration chamber and the freezing chamber.

FIG. 1 shows a front view of an external form of a refrigerator and FIG. 2 shows a partial front view of a shape that a door for a refrigerator adopting an elevation adjustment apparatus for a shelf in a refrigerator according to the present embodiment is opened.

Referring to FIGS. 1 and 2, a body of a refrigerator 100 is formed in an approximate rectangular parallelepiped shape. The inside of the body 100 is provided with a refrigeration chamber 120 and a freezing chamber 140 for the refrigeration storage and frozen storage of foods. The refrigeration chamber 120 and freezing chamber 140 is partitioned by a barrier (not shown) so that they are formed on the upper and lower portions of the refrigerator. Also, the refrigeration chamber 120 and the freezing chamber 140 are provided with a door 122 for the refrigeration chamber and a door 142 for the freezing chamber to selectively shield the refrigeration chamber 120 and the freezing chamber 140.

The door 122 for the refrigeration chamber is provided in a form of a side by side door type door on the left and right thereof, respectively, so that it can be opened by rotating the front surface of the refrigeration chamber 120 to the left and right. The door 142 for the freezing chamber is tilted by a predetermined angle and is then constituted to be opened by being drawn in and out in a drawer type.

Also, the front surface of the door 122 for the refrigeration chamber is further provided components for user convenience such as a home bar or a dispenser.

Meanwhile, reviewing the inside of the refrigerator with reference to FIG. 2, the inner space of the refrigerator 120 is partitioned by a plurality of drawers 160 and shelves 200 provided in the inside of the inner space, wherein each partitioned space receives foods to be stored in a refrigeration state.

More specifically reviewing this, the lower portion of the refrigeration chamber 120 is provided with the drawer 160. The drawer 160 may be constituted in one compartment or two compartments that are separated left and right to be able to store foods with various sizes and may be constituted to control the internal temperature to be conformed to kinds of foods received in the inner side of the drawer 160 by controlling the supply quantity of cold air supplied to the inner side of the drawer 160.

And, the upper portion of the drawer 160 is provided the plurality of shelves 200. The shelf partitions the inside of the refrigeration chamber 120 up and down and is provided in plural. The shelf is provided to the left and right of the refrigeration chamber 120, respectively. Each of the plurality of shelves 200 is constituted to selectively control their elevations according to a simple user operation so that the inner space of the refrigeration chamber 120 can be variously produced. To this end, the inside of the refrigeration chamber 120 is provided with an engaging guide 300 and a roller guide 520 lengthily formed up and down and the shelf 200 is constituted to be moved up and down along the engaging guide 300 and the roller guide 520.

The constitution of the shelf and the engaging guide will be described in detail with reference to FIGS. 3 and 4.

FIG. 3 shows a rear perspective view of the shelf being a main component of the present embodiment viewed from the rear and FIG. 4 shows a bottom perspective view of a shape that a drawer being a main component of the present embodiment is mounted, viewed from the bottom.

Referring to FIGS. 3 and 4, there are shown a shelf plate 220 and a shelf plate 240 as portions receiving articles in the shelf 200.

In detail, the shelf plate 220 forms the upper surface of the shelf 200 so that foods can be safely seated when receiving foods. The shelf plate is formed in a plate shape in an approximate quadrangular shape. Most area of the shelf the is formed of transparent plastic or tempered glass to confirm foods on the lower portion of the shelf 200 and an outer circumference thereof is formed with an edge by means of the plastic material.

The shelf frame 240, which forms the frame of the shelf 200, is constituted by a front end frame 242 and a rear end frame 244 forming the external form of the front end and the rear end and side end frames of the left and right, and is formed in a quadrangular frame corresponding to the shelf plate 220 and is formed to safely seat the shelf plate 220 on the upper portion thereof.

And, the shelf frame 240 is coupled with the engaging guide 300 by means of an engaging apparatus 400 to be described below in detail to support the shelf plate 220 on the lower portion thereof.

The shelf frame 240 is formed of a steel material or a plastic material. When the shelf frame 240 is formed of the steel material, it is formed by an angle with a shape of an approximate 'L" letter to easily mount the engaging apparatus 400 and a rolling apparatus 500, or the like to be described below.

Of course, the shelf plate 220 and the shelf frame 240 can be formed in a single body. In this case, all of the shelf plate 220 and the shelf frame 240 is preferably formed of the plastic material.

The inner side of the refrigeration chamber 120 is provided with two engaging guides 300. The engaging guide 300 is detachably and selectively coupled with the engaging apparatus 400 to be described in detail to determine the elevation of the shelf and is lengthily formed on a rear wall surface of the inner side of the refrigeration chamber 120 adjacent to both sides of the rear end of the shelf 200. The engaging guide 300 is formed to be slightly protruded from the rear wall surface of the inner side of the refrigeration chamber 120, wherein the shape of the cross section thereof can be formed in an approximate quadrangular shape. And, the protruded front surface of the engaging guide 300 is formed with engaging members 320.

The engaging member 320 is coupled with one side of the engaging apparatus 400 to be described below and is formed on the front surface of the engaging guide 300 in a perforated form. Also the engaging member 320 is formed in a form that the one side of the engaging apparatus 400 can be inserted. The plurality of engaging members 320 are formed on the front surface of the engaging guide 300 at a constant interval so that the shelf can be fixed at various positions.

The one side of the shelf 200 and the inner side of the refrigeration chamber 120 corresponding thereto are further provided with the rolling apparatus 500. The rolling apparatus 500 is to smoothly and stably move the shelf 200 when moving the shelf 300 up and down and is constituted by a roller guide 520 and a roller 540.

The roller guide 520 is lengthily formed up and down and contacts the roller 540 to be described below to guide the smooth movement of the shelf 200. The roller guide 520 is attached to the left and right of the rear wall surface of the inner side of the refrigeration chamber 120. The roller guide 520 is preferably mounted to position between the engaging guides 300 provided to the left and right. In order to stably operate the roller to be described below, the cross section shape of the inner side of the roller guide 520 is formed in a '>' shape to protrude it outside.

The rear end of the shelf 200 is provided with the roller 540. The roller 540 contacts the roller guide 520 to perform the rolling movement. The roller rotates along the roller guide 520 to assist the smooth movement of the shelf 200. More specifically describing this, the rollers 540 are mounted on the left and right of the rear surface of the rear end frame 244 of the shelf 200 and is rotatably mounted on the rear end frames 244 constituted by two on the upper and lower, respectively, so that four rollers are mounted. And, the outer circumferential surface of the roller 540 is formed with a roller groove 542 in a '>' shape corresponding to the outer circumferential surface of the roller guide 520 and the roller groove 542 makes a rolling movement in a state linked with a portion protrudedly formed on the outer side of the roller guide 520. The roller 540 is not separated from the roller guide 520 so that it can stably be moved as well as can support the load of the shelf 200 by means of the roller 540.

A roller 540 is provided by two on the left and light of the rear end frame 244, respectively. The rollers simultaneously contacts the roller guides 520 so that the shelf 200 can stably be moved up and down without being twisted.

Meanwhile, an engaging apparatus 400 is provided on the left and right of the rear surface of the shelf 200. The engaging apparatus 400 is to move the shelf 200 to a desired elevation and then engage it. The engaging apparatus is constituted to selectively release the restriction of the shelf 200 only by a simple operation such as a rotation to a predetermined angle as well as to facilitate the up and down movement of the shelf 200.

FIG. 5 shows an exploded perspective view of a constitution of an engaging apparatus in an elevation adjustment apparatus for a shelf in a refrigerator according to the present embodiment.

Reviewing the engaging apparatus 400 in more detail with reference to FIG. 5, the engaging apparatus comprises an operating lever 420 and an elastic member 440.

The operating lever 420 is rotated by the user operation so that it is contacted with the engaging guide 300. The position of the operating lever 420 can be supported by the contact with the engaging guide 300 so that it can be constituted to fix the position of the shelf 200.

More specifically reviewing this, the operating lever 420 is constituted by a holding part 422, an engaging part 324, and a rotating part 426 and is formed of a material in a bent plate shape with a relatively narrow width. The holding part 422 is to hold the operating lever 420 when a user rotates the operating lever 420. The holding part 422 is lengthily formed toward the front end of the shelf 200 and is formed to be lengthily extended for user convenience.

The front end of the holding part 422 is provided with the engaging part 424 that is extendedly formed to be bent downward at approximately 45°. The engaging part 424 is coupled with the engaging member 320 of the engaging guide 300 to engage the shelf 200. The engaging part 424 is extendedly formed to a sufficient length to insert the front end thereof into the engaging member 320 in the state where it is horizontal to the shelf 200. In detail, the front end of the engaging part 424 is formed with an insertion end 425. When the shelf 200 is engaged by means of the operating lever 420, the engaging part 424 is inserted into the inner side of the engaging member 320. It is preferable that the engaging part 424 is protrudedly formed forward from the front end of the engaging part 424 and is formed to have a width corresponding to the width of the engaging member 320 so that it can be inserted into the opened engaging member 320.

Meanwhile, a supporting end 427 is formed on both ends of the left and right of the engaging member 424. The supporting end 427 maintains the state where the insertion end 425 is inserted to continuously fix the shelf 200. The supporting end 427 is formed to be vertically bent downward from the left and right of the engaging part 424. The front end of the supporting end 427 is formed to be positioned at the rear of the insertion end 425 rather than the front end thereof so that when the insertion end 425 is inserted into the engaging member 320, the front end of the supporting end 427 contacts the front surface of the engaging guide 300 to allow the insertion end 425 to be inserted into the engaging member 320, making it possible to maintain the coupled state with each other. In the drawing, the supporting end 427 is shown in the bent and protruded form, but it is not limited thereto. That is, even though any form with a wider width over other widths of the engaging part 424 may be provided, the basic operation of the supporting end 427 is not affected. However, in order to improve the reliability of the supporting action, it is preferable to allow the supporting end to be bent and extended.

The front portion of the holding part 422, that is, the position adjacent to the engaging part 424 is formed with the rotating part 426. The rotating part 426 is shaft-coupled to the one side of the shelf 200 so that it is formed to be vertically bent at the left and right of the front of the holding part 422. The rotating part 426 is mounted to be overlapped between the coupling part 241 protrudedly formed downward on the lower surface of the rear end frame 244 and is pin-coupled by means of a rotation axis 427 penetrating through the coupling part 241. Therefore, the operating lever 420 can be rotated based on the rotation axis 427 and the engaging part 424 can be rotated according to the operation of the holding part 422.

The end protruded by holding the rotating part 426 and the coupling part 241 is mounted with a stop pin penetrating through the rotation axis, thereby preventing the unintended separation of the rotation axis 427.

Meanwhile, the rotation axis 427 is mounted with the elastic member 440. The elastic member 440 forcibly rotates the operating lever 420 in one direction. The engaging part 424 of the operating action 420 is inserted into the engaging member 320 of the engaging guide 300 by the elastic force provided by the elastic member 440, thereby maintaining the coupling state thereof. It is preferable for the elastic member 440 to adopt a torsion spring wound multiple times. And, in order to provide the elastic force to the operating lever 420 in one direction, the one end of the elastic member 440 is fixed by contacting the upper surface of the rear end frame 244 and the other end thereof is inserted into the inserting hole 423 that is perforated on the front end of the holding part 422 so that when the operating lever 420 rotates, it is mounted to apply the restorting force to the operating lever 420.

Hereinafter, the operation of the present embodiment having such a constitution will be described with reference to the drawings.

FIG. 6 shows a perspective view of a shape that the shelf in the elevation adjustment apparatus for the shelf in the refrigerator according to the present embodiment is moved upward and FIG. 7 shows a schematic side view of the operation of the engaging apparatus in the state where the shelf in the elevation adjustment apparatus for the shelf in the refrigerator according to the present embodiment is moved upward.

Referring to FIGS. 6 and 7, the mount position of the shelf 200 is fixed in the state where the external force is not applied. This is made by means of the engaging apparatus 400. The front end of the engaging part 424, that is, the insertion end 425 is inserted into the engaging member 320 of the engaging guide 300 by maintaining the state where the operating lever 420 is always rotated in a clockwise direction (based on FIG. 7) by means of the elastic force of the elastic member 440.

In the state where the insertion end 425 is inserted into the engaging member 320, although the weight of the shelf 200 or the weight of foods received in the shelf 200 is applied downward, the engaging part 424 serves as a lever so that it is fixed to allow the shelf 200 not to go down any more downward.

As shown in FIGS. 6 and 7, in order to widen the space of the lower side of the shelf 200 by moving the shelf 200 in the stopped state upward, a user lifts the shelf 200 up while holding the shelf 200 or both sides of the shelf frame 240. At this time, the restricting force of the engaging apparatus 400 is temporarily released to move the shelf 200 upward.

Describing again, if the shelf 200 or the shelf frame 240 is lifted upward (in an arrow direction of reference numeral 1), the insertion end 240 is temporarily pushed by the engaging guide 300 to very slightly rotate the operating lever 420 in a counter-clockwise direction, thereby compressing the elastic member 440. In this state, the insertion end 425 is completely slipped out from the engaging member 424 and in the state where the engaging force of the shelf 200 is released, the shelf 200 can be freely moved upward (in an arrow direction of reference numeral 2). Upon continuously lifting up the shelf 200 and moving it upward, the insertion end 425 moves upward across the plurality of engaging member 320 and is continuously crushed against the engaging member 320 by the restoring force of the elastic member 440, thereby producing a rhythmical sound.

And, when lifting up the shelf to a desired elevation and then spreading out a hand holding the shelf 200 to remove the external force applied to the shelf 200, the operating lever 420 is back rotated in a clockwise direction (based on FIG. 7) by means of the restoring force of the elastic member 440 so that the insertion end 425 of the engaging part 424 is inserted into the inner side of the engaging member 320 of the engaging guide 300. At this time, the weight of the shelf and the weight of foods put on the shelf 200 are added so that the shelf is depressed downward. As a result, the insertion end 425 inserted into the engaging member 320 of the engaging guide 300 serves as a lever so that it is fixed to allow the shelf 200 not to go down any more downward, thereby maintaining the mount position of the shelf 200.

In this case, the torque applied by the load of the shelf itself and the self load of foods put on the shelf can be supported by means of the rolling apparatus.

Next, in order to increase the space on the shelf 200, the elevation of the shelf 200 must be lowered. To this end, the user operates the engaging apparatus 400, that is, the operating lever 20 to release the locking action of the engaging apparatus and then move the shelf downward.

FIG. 8 shows a perspective view of a shape that the shelf in the elevation adjustment apparatus for the shelf in the refrigerator according to the present embodiment is moved downward and FIG. 9 shows a schematic side view of the operation of the engaging apparatus in the state where the shelf in the elevation adjustment apparatus for the shelf in the refrigerator according to the present embodiment is moved downward.

Referring to FIGS. 8 and 9, in order to move the shelf 200 downward, the user simultaneously holds the holding part 422 and the shelf to lift the holding part upward, thereby rotating the operating lever in a counterclockwise direction (in an arrow direction of reference numeral 1). When rotating the operating lever 420 in a counterclockwise direction by pressing the holding part 422, the engaging part 424 is also rotated in a counterclockwise direction. With this, the insertion end 425 of the engaging part 424 is slipped out from the engaging member 320 of the engaging guide 300.

When the insertion end 425 is slipped out from the engaging member 320, the shelf 200 is in a free state without a separate engaging structure. When lightly falling the hand holding the shelf 200, the shelf 200 is naturally moved downward by means of the weight of the shelf 200 and the weight of foods received in the shelf 200 (an arrow direction of reference numeral 2). At this time, the elastic member 440 is in a compressed state by means of the rotation of the operating lever 420 and is in a state continuously applying the restoring force to the operating lever 420. When moving the shelf 200 downward to a desired position and then taking off the hand pressing the shelf 200 to remove the external force applied to the operating lever 420 200, the operating lever 420 is back rotated in a clockwise direction by means of the restoring force of the elastic member 440.

When the operating lever 420 is rotated in a clockwise direction, the insertion end of the operating lever 420 is inserted into the neighboring engaging member 320 of the engaging guide 300 so that the engaging part 424 is in the state coupled with the the engaging guide 300.

In such a state, when taking off the hand supporting the shelf 200, the shelf 200 is sinked downward by means of the weight of the shelf 200 itself and the weight of foods on the shelf 200. At this time, the engaging part 424 serves as a lever to allow the shelf 200 not to move downward, thereby fixing the position of the shelf 200.

Meanwhile, when moving the shelf 200 upward and downward, the roller 540 mounted to the rear end frame 244 performs the rolling movement along the roller guide 520. The shelf 200 can be smoothly moved upward and downward by means of the rolling movement of the roller 540.

That is, in the up and down movement of the shelf 200, the operating lever 420 and the engaging guide 300 perform a function engaging the shelf 200, while the shelf 200 can be smoothly moved upward and downward without being leaned left and right or being separated. The protruding part of the roller guide 520 performs a relative movement in a state received in the roller groove 542 of the roller 540 so that the shelf 200 can be moved more stably. The shelf 200 can be moved up and down by means of the roller provided by two on the left and right, respectively, without being twisted or inclined.

Also, the rolling apparatus 500 functions to allow the front end of the position fixed shelf 200 by the engaging apparatus 400 to provide the force supporting the torque intending to rotate downward. Therefore, it can be appreciated that both the torque allowing the shelf to rotate forward and the function of the load supporting apparatus supporting the load by means of the rolling apparatus 500 are performed.

Another embodiment of the present invention will be described. However, the following another embodiment is the same as the embodiment described above except for the rolling apparatus and therefore, the description of other components quotes the embodiment described above. However, only the rolling apparatus will be described in detail.

FIG. 10 shows a schematic side view of a constitution of another embodiment of an elevation adjustment apparatus for a shelf in a refrigerator according to the present invention and FIG. 11 shows a schematic view of a cross section of line I-I' of FIG. 10.

The rolling apparatus 501 of the present embodiment comprises a receiving guide 560, a protruding part 580, and a rolling member 582.

In detail, the receiving guide 560 is mounted on one side of the refrigeration chamber 120, more specifically on the left and right of the rear of the refrigeration chamber 120, respectively, to guide the up and down movement of the protruding part to be described below. The receiving guide 560 is lengthily formed and is mounted on the rear wall surface of the refrigeration chamber 120 corresponding both ends of the shelf 200.

The receiving guide 560 is formed to receive the protruding part 580 to be described below and its cross section shape is formed in an approximate '⊏' shape so that it is formed not to separate the inserted protruding part 580.

Also, the protruding part 580 is formed to be vertically extended to backward from the left and right of the rear surface of the rear end frame 244 and its cross section shape is formed in an approximate '⊢' shape to be inserted into the inner side of the receiving guide 560. And, the left end of the protruding part 580 is mounted with a plurality of rolling members 582. When the protruding part 580 is received in the inner side of the receiving guide 560, the rolling member 582, it performs the rolling movement by contacting the inner wall of the receiving guide 560 to smooth the up and down movement of the protruding part 580. Such a rolling member 582 is preferably constituted by a ball bearing or a roller bearing.

In the elevation adjustment apparatus for the shelf in the refrigerator according to the present invention, the action for adjusting the elevation of the shelf 200 is the same as the embodiment described above. However, in the action of the rolling apparatus, the protruding part 580 on both sides of the shelf frame 240 is moved in the state received in the receiving guide 560 so that the separation or flow of the shelf 200 is not caused, thereby stably moving the shelf up and down.

Since the present embodiment can suppress the torque rotating the shelf forward, it can expect an advantage that the reliability of the supporting action against the load of the shelf is improved.

Mode for the Invention

Although the scope of the present invention is not limited to the preferred embodiments, it would be appreciated that changes might be made in this embodiment without departing from the principles and spirit of the invention. Hereinafter, other embodiments belonging to the scope of the present invention will be described.

First, the preferred embodiment of the present invention describes, by way of example, the up and down movement of the shelf 200, but this constitution may be applied to the basket or the drawer in addition to the shelf.

Unlike the preferred embodiment described above, when the engaging guide 300 is not formed in a square column shape whose inner portion is not hollow, the front surface of the engaging guide 300 may be formed with a groove shape collapsed inward or a tooth shape, etc., and it may be changed into various structures capable of selectively restricting some of the engaging apparatus.

Also, in the preferred embodiment described above, the rolling apparatus is provided as the apparatus supporting the rotation torque of the shelf, but is not limited thereto. The form that the rolling apparatus is further provided with a guide bar inserted into the shelf in order for the shelf to support the rotating torque and the guide bar is fixed to the inner wall of the refrigerator can be proposed.

Also, in the preferred embodiments, the rolling apparatus 500 is provided not to be separated by rotating the position fixed shelf by means of the engaging apparatus 400 forward. However, separately from the rolling apparatus 500, any apparatus supporting the shelf may be provided along with the engaging apparatus 400. As described above, any guide bar inserted into the shelf or any hook structure supporting the shelf by hooking on it while not involving the rolling operation may be easily proposed. Furthermore, even in this case, the rolling apparatus is further provided so that the movement of the shelf is stably supported.

Also, the preferred embodiment of the present invention describes that the operating lever and the elastic member are always provided in the engaging apparatus, but is not limited thereto. Even in the case where only the operating lever and its supporting structure are provided in a state not having the elastic member, the same operation may be performed by allowing the user to manually rotate the operating lever. However, viewing the user convenience, it is more preferable for the elastic member to perform it.

INDUSTRIAL APPLICABILITY

The present invention can conveniently operate the elevation of the shelf, move the shelf only by the movement of the shelf without performing the separate work in order to allow the user to move the shelf, and automatically fix the position of the shelf by means of the restoring force of the elastic member after the movement of the shelf is completed. Therefore, the present invention has an effect of improving the user convenience.

Also, since the shelf can be moved to a desired position at a time irrespective of the movement distance of the shelf, the present invention has an advantage that the elevation of the shelf can be rapidly adjusted without exerting a great force.

The invention claimed is:

1. An elevation adjustment apparatus of a shelf in a refrigerator, comprising:

a pair of engaging guides fixed in the inside of the refrigerator, the pair of engaging guides configured to vertically extend, each of the engaging guides having at least one engaging member;

a shelf movably mounted up and down along the engaging guide;

a pair of engaging apparatuses rotatably coupled to rear end parts of the shelf and restricting the downward movement of the shelf in such a manner that an end part of each engaging apparatus is selectively hooked in the at least one engaging member of each engaging guide by a rotation operation; and a load supporting apparatus supporting the load of the shelf at the position where the shelf is fixed by the engaging apparatus, wherein each of the pair of engaging apparatuses includes:

an operating lever rotatably mounted on one side of the shelf, the operating lever defining a rotational axis, one end part of the operating lever being hooked in the at least one engaging member of the engaging guide; and an elastic member providing elastic force in a direction that the one end part of the operating lever is hooked in the at least one engaging member of the engaging guide, the rotational axis passing through the elastic member, wherein the shelf is configured to move up and down while maintaining a horizontal state along the load supporting apparatus, and wherein one end part of the operating lever is automatically separated from the at least one engaging member and the elastic member is compressed by the rotation of the engaging apparatus, when the shelf moves up.

2. The apparatus as claimed in claim 1, wherein the at least one engaging member of each engaging guide includes a plurality of engaging members which are spaced at a front of the engaging guide such that the one end part of each operating lever is selectively hooked into one of the plurality of engaging members.

3. The apparatus as claimed in claim 1, wherein the plurality of engaging guides are respectively provided on left and right sides of a rear part of the shelf, respectively.

4. The apparatus as claimed in claim 3, wherein the load supporting apparatus comprises:

a pair of roller guides which are fixed to an inner rear wall of the refrigerator, the pair of roller guides configured to be vertically extended between the pair of engaging guides, and each roller guide disposed adjacent to each engaging guide; and a plurality of rollers rotatably coupled to the rear part of the shelf and rolling along the roller guides.

5. The apparatus as claimed in claim 1, wherein the load supporting apparatus comprises:

a pair of protruding parts protruded backward from the rear of the shelf;

a pair of receiving guides vertically extended between the pair of engaging guides and fixed to an inner rear wall of the refrigerator to support the protruding parts respectively; and at least one rolling member interposed in a contacting part between the receiving guide and the protruding part to help the shelf smoothly move.

6. The apparatus as claimed in claim 1, wherein the operating lever includes:

a holding part that a user holds with fingers;

a rotating part rotatably coupled to the shelf, the rotating part defining the rotational axis; and an engaging part hooked in the at least one engaging member of the engaging guide, wherein the holding part, the rotating part and the engaging part are formed in one body.

7. The apparatus as claimed in claim 6, wherein a width of an end part of the at least one engaging part is narrower than that of another part of the at least one engaging member.

8. The apparatus as claimed in claim 1, further comprising another load supporting apparatus, wherein said load supporting apparatus and said another load supporting apparatus are provided on left and right sides of the rear of the shelf, respectively.

9. The apparatus as claimed in claim 1, wherein the elastic member is a torsional spring.

10. The apparatus as claimed in claim 6, wherein the elastic member is a torsional spring.

* * * * *